United States Patent [19]

Westendorf et al.

[11] 4,150,766

[45] Apr. 24, 1979

[54] DISPENSING APPARATUS

[76] Inventors: Thomas H. Westendorf, 1524 Lindenhurst Dr., Dayton, Ohio 45459; Robert H. Knorr, 21 Medway Dr., Medway, Ohio 45341

[21] Appl. No.: 778,959

[22] Filed: Mar. 18, 1977

[51] Int. Cl.[2] ..... B65G 59/00

[52] U.S. Cl. ..... 221/112; 221/119; 221/203; 221/265; 221/299

[58] Field of Search ..... 221/277, 263–266, 221/298, 112–116, 119–122, 83, 86, 200, 202–204, 299, 300; 222/367, 368, 370, 363, 366, 451, 452; 206/536, 539

[56] References Cited

U.S. PATENT DOCUMENTS

| | | | |
|---|---|---|---|
| 2,886,209 | 5/1959 | Lermer | 222/452 |
| 3,241,712 | 3/1966 | Sacchetti et al. | 221/265 |
| 3,294,284 | 12/1966 | Chamber | 221/122 |
| 3,722,740 | 3/1973 | List | 221/265 |
| 3,991,908 | 11/1976 | Thomas et al. | 221/265 |

FOREIGN PATENT DOCUMENTS

| | | | |
|---|---|---|---|
| 2045313 | 3/1972 | Fed. Rep. of Germany | 221/265 |
| 1262061 | 4/1961 | France | 221/264 |

*Primary Examiner*—Robert J. Spar
*Assistant Examiner*—H. Grant Skaggs
*Attorney, Agent, or Firm*—Jerome P. Bloom

[57] ABSTRACT

A dispenser comprising a housing having at least one chamber arranged to receive and store articles in pill, pellet, tablet or capsule form in bulk quantities. Embodied in connection with the housing is a feed device, a magazine and a dispensing device. The feed device directs articles from the chamber to load the magazine. The dispensing device is constructed and arranged to normally prevent exit of articles from the magazine and in the operation thereof to provide for passage of a predetermined quantity of articles from the magazine and from the housing. The feed device is operatively connected to the dispensing device to move in conjunction therewith and serve its function in a timed relation to the function of the dispensing device. In the operation thereof the dispensing device functions to agitate the feed device in a manner to insure that the magazine is maintained in a fully loaded condition as long as sufficient articles remain in said chamber.

9 Claims, 10 Drawing Figures

FIG-1
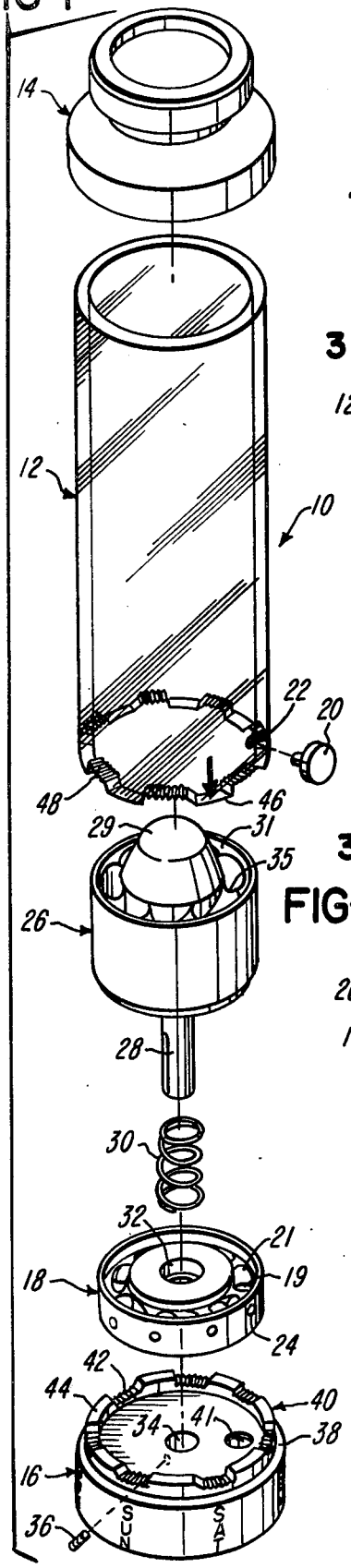
FIG-2
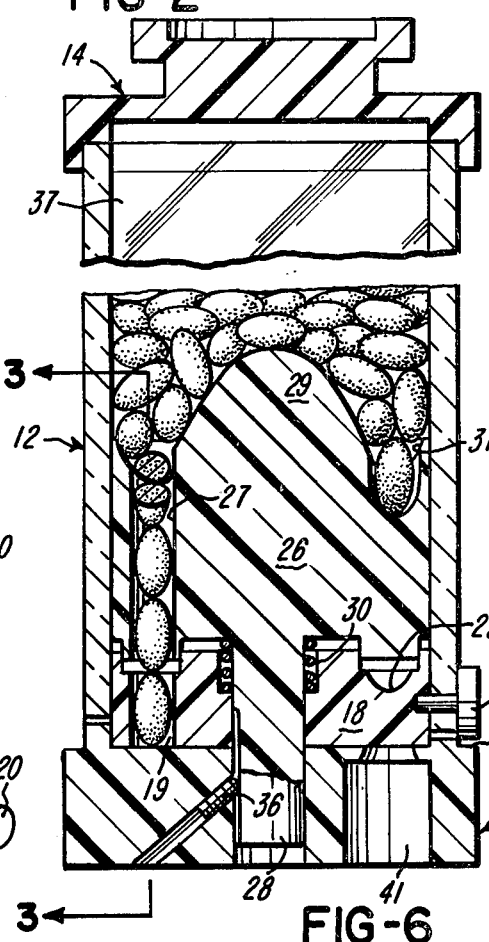
FIG-3
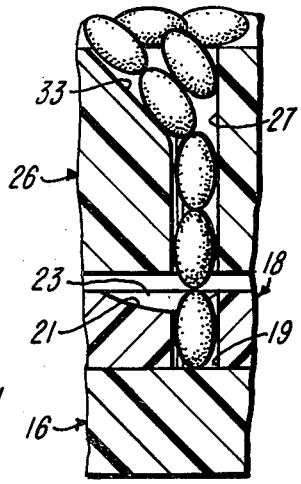
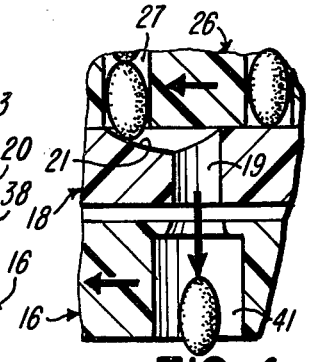
FIG-4
FIG-5
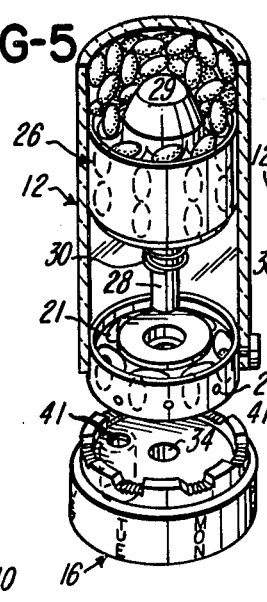
FIG-6
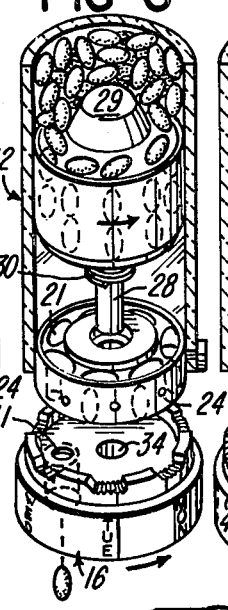
FIG-7
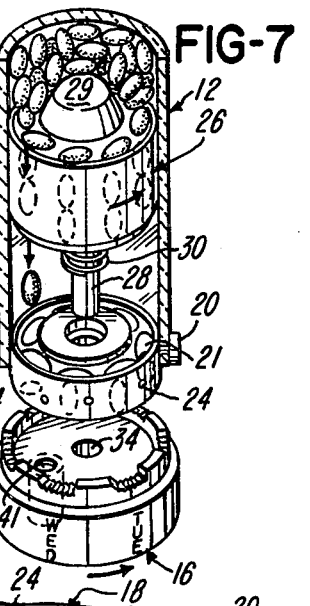
FIG-8
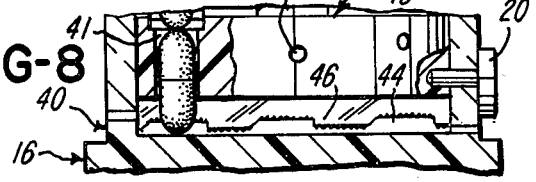

DISPENSING APPARATUS

BACKGROUND OF THE INVENTION

This invention relates to dispensing apparatus and more particularly to improvements in such apparatus enabling a simple fabrication of home dispensers for articles in pill, pellet, tablet or capsule form. It will be particularly described with reference to its application to the dispensing of items such as drugs and vitamins. It is to be understood, however, and it should be obvious, that its application is not so limited and such is not intended.

Prior art efforts have indicated that it has been exceedingly difficult to create a home dispenser for drugs and vitamins that is reasonably satisfactory in substantially all respects.

A basic problem which has continued to exist for those individuals who must take drugs daily is a tendency on their part to forget whether or not they have actually taken the required drugs at a particularly required time. Such problem has not in any respect been adequately handled in the design of prior art drug dispensers. Moreover, prior art dispensers which have heretofore been made available for the dispensing of drugs at home have either poorly functioned or been so complex and expensive as to make them undesirable for home use. The prior art exhibits, also, a lack of a dispenser adapted for home use the construction of which would enable the simultaneous dispensing of a plurality of drug-type articles at the same time, particularly articles the size and shape of which might differ.

It was to the solution of the above noted problems that the efforts which resulted in the present invention were directed.

SUMMARY OF THE INVENTION

An embodiment of the present invention provides a home type dispenser for drugs, the housing for which is basically comprised of a tube one end of which is closed by a filler cap and the other by a relatively rotatable dispensing device which in the normal orientation of the housing forms its base.

A magazine having a plurality of circularly spaced chambers formed by through passages is fixed in the lower end of the tube, in its normal position, immediately over the dispensing device which includes a single aperture. Positioned immediately above the magazine, within the tube, is a feed drum having passages therethrough which correspond in number and spacing with the passages defining the chambers in the magazine. The feed drum and the dispensing device are interconnected, for their conjoint rotation, by a shaft, which is rotatable in and extends through a central aperture in the magazine. In the normal inoperative position of the dispensing device the passages in the feed drum are respectively in direct alignment with the corresponding passages in the magazine.

The innermost end of the feed drum forms the bottom of a storage chamber in the dispenser housing which is filled with drugs or vitamins, in pill, pellet, tablet or capsule form, upon removal of the filler cap.

The dispensing device and the tube, which define the peripheral wall of the dispenser housing, have a ratchet-like connection which provides that the dispensing device may be rotated in step-by-step increments to achieve a complete cycle of its rotation in the course of each of which the single aperture in the dispensing device will align with a different passage or chamber in the magazine to receive therefrom and to pass therethrough its contents.

A spring interposed between the magazine and the feed drum normally biases the dispenser device inwardly to the tube structure so the ratchet-like formations on the respective abutting surfaces thereof nest, one relative the other.

In the use of the dispenser, in its normally inoperative position the dispensing device blocks exit of the drugs or other articles temporarily located in the chambers or passages in the magazine, which chambers are automatically filled from the storage chamber in the housing by way of the passages in the feed drum. The upper end of the feed drum is contoured to facilitate the natural flow of articles into and through the feed drum to load empty passages in the magazine as they align with the passages in the drum.

When one desires to dispense an article from the housing, the tube defining its peripheral wall is held in one hand while the dispensing device is rotated to step it a single increment as permitted by the ratchet-like formations. During the movement of the dispensing device occasioned thereby, and intermediate the limits of such movement, the aperture in the dispensing device will come into alignment with one of the passages or chambers in the magazine, through which, as previously noted, the article in such chamber will drop. When its increment of movement is completed and the dispensing device resumes its inoperative position it will be biased to its nested relation with the adjacent end of the tube.

The dispensing device moves outwardly of the tube against the bias of the spring between the feed drum and the magazine during its dispensing function. As it reseats, the feed drum moves inwardly of the dispenser housing, in the process of which to agitate the articles in the storage chamber and induce, as a result thereof, one of the stored articles to move into the passage in the feed drum the contents of which move at the same time into the empty chamber of the magazine which has emptied through the aperture in the dispensing device.

The passages or chambers of the feed drum and magazine are circularly and equidistantly spaced to define stations with respect to each of which the dispensing device is successively indexed in the course of one cycle of its rotation. In the case illustrated the number of stations correspond to the number of the days of the week. This arrangement is such to enable a quick determination as to whether or not the required drug or drugs have been taken on a particular day.

As will be seen, the feed drum and magazine may also embody a plurality of through apertures or chambers in each of said stations, in which case the dispensing device will have a corresponding grouping of apertures at a single station therein.

It should be self evident that instead of having a number of stations corresponding to the days of the week, one might have a number of stations which correspond to the number of intervals of a day, at which times the drugs in the dispenser housing must be taken.

In preferred embodiments the magazine is so connected to the tube forming the peripheral wall of the dispenser housing as to enable its relative axial adjustment. This provides means which enable the chambers of the magazine to accommodate articles of different lengths. It is accordingly a primary object of the invention to provide a new and improved dispenser having particular advantage for application to dispensing of articles in pill, pellet, tablet or capsule form which is economical to fabricate, more efficient and satisfactory in use, adaptable to a wide variety of applications and unlikely to malfunction.

A further object of the invention is to provide a dispenser particularly adapted for the dispensing of articles such as drugs or vitamins and particularly suited for home use.

Another object of the invention is to provide an improved dispenser for home use particularly adapted for the dispensing of articles such as drugs or vitamins which is designed to enable an individual to check as to whether or not the drugs or vitamins have been taken at the required time.

Another object of the invention is to provide a dispenser for home use having particularly advantageous application for the dispensing of vitamins or drugs which facilitates the extraction of a plurality of different or different size drug type or vitamin type articles at the same time.

An additional object of the invention is to provide a dispenser for home use which possesses the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiments of the invention, FIG. 1 is an exploded view of a dispenser in accordance with the invention;

FIG. 2 is a vertical sectional view thereof;

FIG. 3 is a fragmentary sectional view illustrating elements of the device at a time when it is in an inoperative condition;

FIG. 4 illustrates, in a fragmentary view, the dispensing operation of the device;

FIGS. 5 through 7 are fragmentary exploded views which illustrate the complete function of the device;

FIG. 8 is a fragmentary sectional view which illustrates a further feature of the device which enables it to handle the dispensing of articles of different length;

Like parts are indicated by similar characters of reference throughout the several views.

Figure 10:
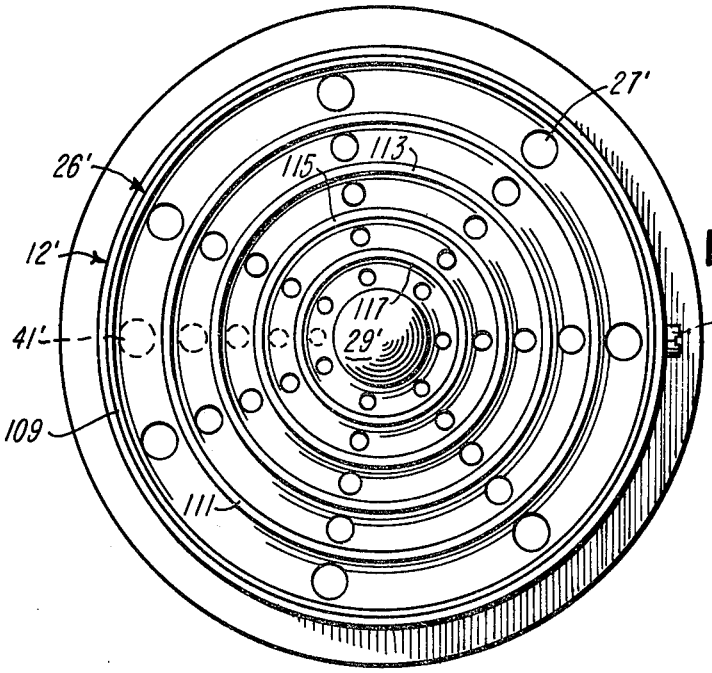
FIG. 10 is a top view of the modified device of FIG. 9 with its filler cap removed.

The embodiment of the invention herein illustrated includes an axially elongated tube 12 defining the peripheral wall of a housing 10, the other elements of which comprise a releasable filler cap 14 for what may be considered its top or inlet end and an attached dispensing cap 16 for its opposite or base end which serves as a dispensing device. A multi-apertured magazine 18 is fixed interiorly of the tube 12 immediately above the cap 16 by means of a headed pin 20. The peripheral wall surface of the magazine 18 has a series of circularly and axially spaced recesses 24 adapted to be selectively aligned with a single aperture 22 in the tube 12 through which the pin 20 may be thrust to engage in a radially directed recess 24 in the outer wall surface of the magazine 18. As will be obvious, the magazine may be rotated to align a particular recess 24 with the aperture 22 for the fixing of its position in accordance with its application. Dependent on the recess 24 selected, one may selectively position the bottom surface of the magazine with reference to the immediately adjacent upper surface of the dispensing cap 16 in immediately adjacent relation thereto or spaced therefrom to a predetermined degree. The purpose of this spacing will be further described.

A drum 26 providing a feed device, which has a generally cylindrical peripheral outline, is positioned immediately over the magazine 18 in the tube 12. A pin 28 one end of which is fixed in an accommodating cavity in the center of the bottom of the drum 26 extends through a cylindrical compression spring 30 and then freely through a central aperture 32 in the body of the magazine 18 to be finally fixed in a central aperture 34 in the body of the dispensing cap 16 by means of a innerconnecting pin 36. By such means the drum 26, the outer wall surface of which bears on the inner wall surface of the tube 12, is fixed for rotation with the cap 16 and relative to the tube 12 and the intermediately disposed magazine 18. The cap 16 as shown in FIG. 1 comprises a disc-shaped body 38 the diameter of which is slightly greater than that of the tube 12. Spaced immediately inward of its outer periphery the upper surface of the disc 38 has formed integral therewith a perpendicularly and upwardly directed ring-like projection 40 which if placed end to end with the tube 12 forms an axial extension of the wall structure defined thereby. The projected or upper edge of the projection 40, considering the orientation illustrated, is cut to form therein a series of seven equidistantly spaced, equal, and similarly configured notches 42 which form in the projection 40 a series of seven equidistantly spaced, identically configured ratchet-like teeth 44. At one end thereof each tooth 44 has a wall surface perpendicular to the base plane occupied by the uppermost surface of the cap 16. The opposite end of each tooth 44 is, by contrast, sloped downwardly and outwardly, at a 45° angle to the underlying uppermost plane surface of the cap 16 which provides a dispensing disc, as will soon become obvious. The end of the tube 12 immediately adjacent the cap 16 is cut similarly to the projection 40 to form thereon ratchet-like teeth 46 spaced by notches 48 complementary in shape, respectively, to the notches 42 and the teeth 44.

As will be further described, in the inoperative position of the dispensing device as represented by the cap 16 the notches 42 will accommodate the teeth 46 as the teeth 44 nest in the notches 48, the arrangement providing in such instance that the projection 40 does in fact form an axial extension and a separable part of what may be considered the peripheral wall of the housing 10, the other part of which wall is provided by the tube 12.

The tube structure 12 and the cap 14 and the drum 26 define a chamber area 37 above the drum 26 the bottom surface of which chamber is provided by the end of the drum remote from the cap 16. As will be obvious, upon removal of the cap 14 the chamber 37 may be filled with a bulk quantity of any appropriate pill, pellet, tablet or capsule desired, it being understood, as will be further described, that the operative elements of the dispenser unit here described will be appropriately configured accordingly.

With the last point in mind, attention is directed to the fact that the magazine 18 is formed with a series of seven through apertures 19 which are circularly and equidistantly spaced about and so as to have their central longitudinal axes parallel to the central axis of the magazine and to each other. At the end thereof adjacent the feed drum 26 each aperture 19 has a sloping lead-in surface 21 defined by a groove 23 angularly cut downwardly and inwardly thereof. The grooves 23 are arcuate in cross section as to their bounding wall structure and in each case angle inwardly and downwardly to the related aperture in a direction opposite the direction in which the feed drum 26 will rotate in operation of the dispensing device. It will be noted that the grooves 23 lie in a circular pattern commonly occupied by the upper ends of the apertures 19 with which they are in direct communication.

In the embodiment of FIGS. 1 through 8 of the drawings the magazine is shown to have seven equidistantly spaced apertures 19. The feed drum 26 also has seven through apertures, in this case identified by the numeral 27, which are parallel to its central longitudinal axis and circularly spaced similarly to the apertures 19 in the magazine 18. In the end related positioning of the feed drum and the magazine and a positioning of the dispensing cap 16 in its inoperative position, the apertures 27 are positioned to align with and to be respectively coaxial with one of the magazine apertures or chambers 19. The drum 26 has a dome-like central projection 29 from the surface thereof which forms the base of the chamber 37. The base of the dome 29 is peripherally rimmed by a circular groove 31 through the base of which open the upper ends of the apertures 27. Each aperture 27 has a sloping lead-in surface 33 at its end exposed to the chamber 37 to the side portion thereof providing its leading edge, considering the normal direction of rotation of the drum 26 in the operation of the dispensing device. The surfaces 33 are formed by grooves cut inwardly of the feed drum from the base of the groove 31 so as to be sharply inclined. The grooves defined by the surfaces 33 are arcuate in cross section and so extended that the surface left between the upper end of a groove 33 and the following aperture 27 is a thin edged blade-like segment 35 of the drum 36.

Particular attention is directed to the spring 30 between the feed drum and the magazine. This spring 30 provides a bias of the feed drum 26 inwardly of a portion of the housing 10 defining the chamber 37 and at the same time biases the dispensing cap 16 and its projection 40 so the ratchet-like formation on the projection 40 will nest in the ratchet-like formation on the adjacent end of the tube 12 as previously described.

The dispensing cap 16 has a single through aperture 41 formed in the body thereof, which aperture is on a line parallel to its central axis. In the inoperative position of the dispensing cap 16 the aperture 41 is circularly offset from the apertures 19 in the magazine which is immediately thereabove. Under such conditions the ends of the chambers defined by the apertures 19 in the magazine which open to the dispensing cap 16 are sealed by this cap against discharge of the magazine contents.

In the first instance of loading the chamber 37 with the articles to be dispensed, whether they be in pill, pellet, tablet or capsule form, the dome-like projection 29 on the drum 26 provides for such articles to cascade down about its sides and over the groove 31 peripherally rimming its base. Certain of the articles will in the process dispose either partially in or over the grooves 33 which lead to the entrance ends of the apertures 27 which define passages through the drum 26. On holding the tube 12 in one hand and turning the dispensing cap 16 in its provided direction of rotation, by reason of the slope on the leading ends of its ratchet-like teeth 44, the cap 16 will ride up over the teeth 46 against the bias of spring 30 to position outwardly of the teeth 46 at the adjacent end of the tube 12. One rotates the disc to provide the cap 16 a single increment of rotation until the teeth 44 align, respectively, with a notch 48 next following that notch 48 which they have previously occupied. At this time the cap 16 is pulled inwardly to the tube 12 under the influence of the spring 30 which has been compressed in the rotational process. This action produces a condition wherein the apertures or passages 27 in the drum 26 and the passages or chambers 19 in the magazine 18 are directly aligned once more and at the same time the spring action on the feed drum causes an agitation of the bulk contents of the chamber 37. This agitation produces a force pattern which induces articles from the chamber 37 to naturally move into and through the apertures 27 to fill them and to load the magazine passages or chambers 19 in the process. In any event, irrespective of the manner in which the magazine and the feed drum are loaded, at the commencement of the use of the dispenser and to the point of use the cap 16 functions to prevent any discharge of the articles introduced into the chamber 37.

To commence or to produce a dispensing of an article from the magazine, once the magazine is loaded, one need only rotate the cap 16 to advance it a single notch with reference to the tube 12 in a manner as previously described. In the process of this incremental rotation and intermediate the ends of the movement of the cap 16 occasioned thereby the aperture 41 therein will come into alignment with the opening from one of the passages or chambers defined by apertures 19 in the magazine 18, whereupon the article contained therein will drop through the aperture 41 and be available for use, as required. The stepping and timing is such that only a single article may drop through the aperture 41. As the movement of the cap 16 is continued to complete its increment of rotation the magazine is sealed once more from discharge of its contents and the feed drum which has been rotating with the dispensing cap to have its apertures 27 relatively displaced from alignment with the passages 19 once more positions to align its apertures with the passages 19. As this occurs an article exposed at the lower end of the aperture 27 immediately over the passage 19 the contents of which have been discharged will drop into this passage 19. The aperture 27 from which this article is discharged will have introduced therein a replacement article the movement of which has been induced by the jarring or shock action of the release of compression of the spring 30. The relief provided by the lead-in surface at the upper ends of the passages 19 insures that if the end of an article lowermost in an aperture 27 in the drum 26 may slightly protrude into the adjacent upper end of a passage 19, it will on the rotation of the dispensing cap be cammed back into position until it once more overlies an upper end of a passage 19.

The embodiment of FIGS. 1 through 8 as above described is not in any way to be construed as limiting. It presents the basic concepts of the invention in a physical form which illustrates their application to a dispenser wherein drugs or vitamins may be dispensed on a one a day basis. The device lends itself to there being provided peripherally of the cap 16 legends, centered with reference to the respective notches 42 positioned thereabove in the projection 40. These legends may respectively designate, in succession, the days of the week. At the same time an arrow may be provided the head of which is centered on and in reference to the projected extremity of a tooth 46 in connection with the lower end of the tube 12. Thus, at any one time the arrow on the tube 12 will point to the directly aligned legend indicating the day of the week on the cap 16. At such time the apertures 27 and the passages or chambers 19 will be in direct vertical alignment and exit from the passages or chambers 19 will be blocked by the cap 16 being in its inoperative position. If, for example, the arrow indicates the day is Saturday under such conditions, all an individual using the dispenser need do is to look at the dispenser and realize that he or she has not taken the drug or vitamin to be taken on that day. This may be readily seen since the dispensing of the drugs or vitamins occurs only in movement of the cap 16 an increment of rotation. On the rotation of the cap 16 a single increment in the normal manner above described, intermediate the limits thereof the drug or vitamin will be dispensed, in a single pill, pellet, tablet or capsule form as the case may be. When the stepping or incremental rotation of the cap 16 is completed, the day Sunday will be indicated to align with the arrow on the tube 12. This is a clear indication that the Saturday dosage has been taken.

It may accordingly be seen that the concepts of the invention enable a dispenser which has considerable utility and ease of usage by an individual in the home. Moreover, the structural arrangement of the components are such to insure an automatic dispensing operation and at the same time a loading operation in conjunction therewith during and upon the completion of a single increment of rotation of the cap 16 and the feed drum 26 conjointly therewith. The function of the spring 30 has proven to have admirable consequences. There is no difficulty in feeding and loading the magazine and the feed drum and it would appear that the agitating action induced by the spring as each incremental rotation of the cap 16 is completed insures in any case that with the arrangement provided articles dispensed are readily replaced from the storage chamber 37.

Figure 9:
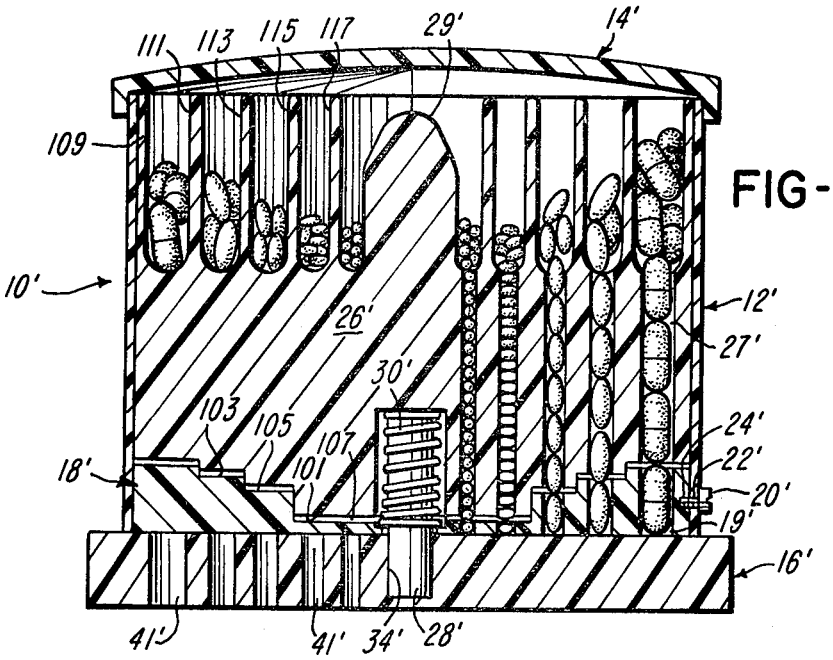
FIG. 9 is a sectional view of a modification of the device of FIGS. 1–8.

The embodiment of the invention illustrated in FIGS. 9 and 10 shows yet another form of embodiment of the invention which is basically comprised of the same components as described with reference to the embodiment of FIGS. 1 through 8. The only difference in this case is the number and arrangement of apertures, passages or chambers and the fact that the feed drum has formed integral therewith means which define a plurality of concentrically positioned and radially spaced circular storage chambers.

More specifically, as in the case of the first described embodiment, the embodiment of FIGS. 9 and 10 includes a tube 12' defining the peripheral wall of a housing 10'. One end of the tube 12' is provided with a releasable filler cap 14' for what may be considered its top or inlet end and an attached dispensing cap 16' is at its opposite or base end. The cap 16' is identical in construction and configuration to the cap 16 with the exception that instead of a single aperture 41 as provided in the cap 16, there is a radially oriented line of radially spaced apertures 41'. In the example illustrated the apertures 41' are five in number and different in size, decreasing in diameter from the outermost aperture to the innermost aperture thereof. In this embodiment, also, the cap 16' and the tube 12' are interrelated by ratchet-like formations identical to those described with reference to the mating portions of the tube 12 and the projection 40 in connection with the cap 16. Since the relationship of these parts is obvious from the previous description, the details of the interrelated ratchet-like formation to be incorporated in the embodiment of FIGS. 9 and 10 are neither illustrated nor described.

The end of the tube 12' which is lowermost is plugged by a disc shaped magazine 18' fixed to the tube 12' by a pin 20' which passes through an aperture 22' in the tube 12' to threadedly engage in a selected recess in the peripheral wall of the magazine 18'. As in the case of the first described embodiment, there are a series of circumferentially and axially spaced recesses 24' in which the pin 20' may be selectively threadedly engaged, the selective engagement being determined by the axial lengths of the articles to be loaded in an dispensed from the magazine.

The surface of the magazine 18' which disposes uppermost in the orientation in which it is shown with reference to the tube 12' is provided with a relatively deep cavity 101 the peripheral wall of which is formed by a series of counterbores. These counterbores form axially spaced annular shoulders 103 and 105 arranged in respectively parallel planes and concentric to each other and the central axis of the magazine in the housing 10'. The effect of these counterbores is to form steps in the peripheral wall of the cavity 101 outwardly and upwardly from the base 107 of the cavity which they rim. Formed in and through the center of the base 107 of the magazine is a through aperture which positions in direct alignment with the central aperture or recess 34' in the cap 16'.

Positioned within the tube 12', above the magazine 18', with its outer peripheral wall surface in bearing relation to the inner wall surface of the tube 12' is a feed drum 26'. The end of the drum 26' which positions adjacent the upper surface of the magazine 18' is shaped complementary to the shape of the cavity 101. As will be seen, the complementary shape of the lower end of the feed drum 26 provides a male formed stepped projection which is relatively nested in the cavity 101.

As in the case of the embodiment first described, one end of a pin 28' is fixed to the feed drum 26' as it extends into an accommodating cavity in the center of the bottom thereof. A coiled compression spring 30' positions about the pin 28' as it extends from the feed drum, through the central aperture in the magazine 18' and into the aperture 34' in the disc 16' where it is fixed. The spring 30' is based at its lower end against a relatively recessed shoulder rimming the upper end of the aperture through the body of the magazine, which shoulder is set inwardly of the base surface 107 of the cavity 101. As the spring is thus applied it serves its function similar to the spring 30, to urge the feed drum 26' to maintain a slightly spaced relation to the magazine 18' and the cap 16' into a position where it is biased against the lowermost end of the tube 12', under which conditions its projection 40' forms an extension of the wall defined by the tube 12'.

In the case of the embodiment of FIGS. 9 and 10 it will be seen from FIG. 10, as well as FIG. 9, that the magazine and the feed drum both are provided with similarly grouped apertures in radial lines, which radial lines of apertures are circularly and equidistantly spaced and are seven in number. In the inoperative condition of the cap 16', in this case as in the case previously described, the apertures 27' formed in the drum 26' will respectively align with corresponding apertures 19' formed in the magazine 18'. Noting FIG. 9, the apertures or chambers 19' are in the inoperative condition of the cap 16' sealed against discharge of their contents.

One distinctive difference in this second described embodiment of the invention is that there are formed integral with the uppermost end of the feed body 26' a series of radially spaced wall structures which are circular in cross section and extend concentric to each other and to a central dome-like projection 29' from the upper surface of the feed drum. Reading from the radial outermost to the radial innermost one of these projected wall structures they are respectively identified by the numerals 109, 111, 113, 115 and 117. The arrangement is such to provide that the upper ends of the apertures 27' open through the base of the respective chambers defined by the projected wall structures in connection with the feed drum. The base of the respective chambers is arcuate in cross section to facilitate that the jarring action produced, in the manner previously set forth with respect to the first described embodiment, as the cap 16' is incrementally rotated to serve a dispensing function insures a continuous feeding of articles from the storage chambers into the associated and communicating ends of the apertures 27'.

The only essential difference achieved in the function of the embodiment of FIGS. 9 and 10 is that intermediately of the stepping of the cap 16' with reference to the tube 12', from one position to the next, a line of apertures 41' will align with a line of apertures 19' in the magazine 18' as they pass from one position to the next set position. As alignment occurs each of the apertures 41' will provide for an unloading of an aligning chamber or aperture 19'. It will therefore be self-evident that the dispensing in this case delivers to the user not one but a plurality of different drugs and/or vitamins which the user might be required to consume at a particular time.

It should be clear that there could be any number of storage chambers and related passages and apertures for directing articles to the magazine 18'. This would be a matter of choice and dependent on the particular application desired. Further it should be clear that any number of chambers may be utilized by different people and one may provide for selective partitioning of the concentric chambers so that one may load selected chambers and thereby provide for a particular article to be dispensed at a particular time and not at another. With this disclosure before one versed in the art, there should be no problem in achieving the modification of the dispenser embodiment to achieve this particular purpose.

Again, in the case illustrated in FIGS. 9 and 10 there are seven radial lines of apertures providing for dispensing on each of the successive days in the week with the previously mentioned benefits and advantages for the user. More than this, the dispenser can be designed to provide four radial lines of apertures in the feed drum and the magazine and a corresponding single line of apertures in the cap 16 which facilitates the use of the dispenser on a daily basis. By means such as here provided or obvious modifications one can then determine by appropriate legends and markings being provided on the peripheral or outer wall surface of the cap 16' related to a fixed arrowhead on the tube 12' whether or not the required dosage has been taken at the indicated time. This avoids the chance missing of a dosage of drugs or other articles of like nature or an accidental duplication of a dosage at a particular time which might be premature and dangerous to the user. Apart from this, it is believed clear that the invention provides basic concepts enabling embodiments of dispensers which avoid the problems above enumerated in respect to the use and fabrication of like applied dispensers of the prior art.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A dispenser for articles in pill, pellet, tablet or capsule form comprising a housing, means defining at least one chamber area in said housing arranged to receive and store said articles in bulk quantities, a magazine having a fixed relation to said housing and having a plurality of passages forming chambers, said magazine chambers being differentially sized to receive different sized articles from said means defining said chamber area, a dispensing device connected for a step by step rotation thereof with respect to said housing, said dispensing device having a plurality of different sized passages corresponding in size to said different sized articles and adapted to communicate with corresponding sized chambers in said magazine in its dispensing operation, and means for directing said articles from said chamber area to load said magazine chambers, said dispensing device having at least one passage to direct articles from said magazine chambers and from a different one or more of said magazine chambers with each step of its rotational movement, said dispensing device being constructed and arranged to normally prevent the exit of articles from said magazine chambers and in the operation thereof to provide for the passage of a predetermined quantity of said articles from said magazine chambers and from said housing, and said means for directing said articles to load said magazine being operatively connected to said dispensing device to move in conjunction therewith and serve its function in a timed relation to the function of said dispensing device.

2. A dispenser for articles in pill, pellet, tablet or capsule form comprising a housing, means defining at least one chamber area in said housing arranged to receive and store said articles in bulk quantities, a magazine having a fixed relation to said housing, a dispensing device connected with said housing, a feed means for directing said articles to load said magazine from said chamber area, said dispensing device being constructed and arranged to normally prevent the exit of articles from said magazine and in the operation thereof to provide for the passage of a predetermined number of said articles from said magazine and from said housing, said feed means being operatively connected to said dispensing device to move in conjunction therewith and serve its function in a timed relation to the function of said dispensing device and means normally biasing said feed means inwardly of said storage chamber area providing that the operation of said dispensing device requires the displacement thereof against the influence of said biasing means.

3. A dispenser for articles in pill, pellet, tablet or capsule form comprising a housing, means defining at least one chamber area in said housing arranged to receive and store said articles in bulk quantities, a magazine having a fixed relation to said housing and having a plurality of passages forming chambers, a dispensing device connected for a step by step rotation thereof with respect to said housing, means for directing said articles from said chamber area to load said magazine chambers, said dispensing device having at least one passage to direct articles from said magazine chambers and from a different one or more of said magazine chambers with each step of its rotational movement, said dispensing device being constructed and arranged to normally prevent the exit of articles from said magazine chambers and in the operation thereof to provide for the passage of a predetermined quantity of said articles from said magazine chambers and from said housing, said means for directing said articles to load said magazine being operatively connected to said dispensing device to move in conjunction therewith and serve its function in a timed relation to the function of said dispensing device, said housing embodying ratchet-like formations, said dispensing device embodying complementarily shaped ratchet-like formations and said dispensing device having resilient means in operative relation thereto to yieldingly urge its said ratchet-like formations to an interengaged and relatively nested relation to those embodied in said housing, by means of which said dispensing device is normally in a set relation to said housing and is adapted for a step by step rotation from one set position to another with reference to said housing.

4. A dispenser for articles in pill, pellet, tablet or capsule form comprising a housing, means defining at least one chamber area in said housing arranged to receive and store said articles in bulk quantities, a magazine having a fixed relation to said housing, a dispensing device connected with said housing, and a means for directing said articles to load said magazine from said chamber area, said article directing means and said dispensing device being respectively disposed to opposite sides of said magazine and being interconnected by a shaft extending through and bearing in said magazine and thereby mounted for conjoint rotation with respect to said magazine, said dispensing device being arranged for movement in a step by step fashion and to serve a dispensing function intermediate the ends of each step thereof, said article directing means and said magazine having spring means interposed therebetween arranged to provide for agitation of said article directing means in correspondence with each step by step movement of said dispensing device, providing thereby that the stored articles are agitated as each dispensing operation takes place to facilitate filling the said article directing means the contents of which serve to reload said magazine as a dispensing operation takes place.

5. A dispenser as in claim 4 wherein said article directing means comprise feed means having a plurality of passages expanded at one end thereof which communicate with said articles in said chamber area to provide a sloping entrance wall portion to facilitate the movement of stored articles to said passages in said article directing means in response to each agitation of said article directing means.

6. A dispenser for articles in pill, pellet, tablet or capsule form comprising a housing, means defining at least one chamber area in said housing arranged to receive and store said articles in bulk quantities, a magazine having a fixed relation to said housing, a dispensing device connected with said housing, a feed means for directing said articles to load said magazine from said chamber area, said dispensing device being constructed and arranged to normally prevent the exit of articles from said magazine and in the operation thereof to provide for the passage of a predetermined number of said articles from said magazine and from said housing, said feed means being operatively connected to said dispensing device to move in conjunction therewith and serve its function in a timed relation to the function of said dispensing device, said magazine having a plurality of circumferentially and axially spaced openings in the peripheral wall surface thereof providing that a pin-like connection applied to said housing may be inserted in a respective one thereof to thereby determine a selected position of said magazine with respect to said dispensing device, providing thereby that said magazine may, in its association with said dispensing device, hold articles having a selected axial length or number.

7. A dispenser for articles in pill, pellet, tablet or capsule form comprising a housing, means defining at least one chamber area in said housing arranged to receive and store said articles in bulk quantities, a magazine having a fixed relation to said housing, a dispensing device connected with said housing, and an article directing means for directing said articles to load said magazine from said chamber area, said chamber area being formed in part by means defining one end of said article directing means, said article directing means being formed to define a plurality of feed passages, each of which aligns with one of a plurality of chambers provided in said magazine in the inoperative condition of said dispensing device and said article directing means is end related to said magazine by a complementary male-female configuration of adjacent ends thereof which nest one relative the other, a spring means being interposed between said article directing means and said magazine to bias said article directing means from said magazine and to bias said dispensing device to seek an inoperative position with reference to said housing, said dispensing device being constructed and arranged to normally prevent the exit of articles from said magazine and in the operation thereof to provide for the passage of a predetermined number of said articles from said magazine and from said housing, and said feed means being operatively connected to said dispensing device to move in conjunction therewith and serve its function in a timed relation to the function of said dispensing device.

8. A dispenser for articles in pill, pellet, table or capsule form comprising a housing, means defining at least one chamber area in said housing arranged to receive and store said articles in bulk quantities, a magazine connected to said housing, said magazine having a plurality of passages forming chambers, a dispensing device connected with said housing to the side of the magazine remote from said chamber area, said dispensing device being connected for a step by step rotation thereof with respect to said housing and having means operative conjointly therewith in the step by step rotation thereof to cause said articles to be directed to said passages in said magazine for loading thereof, said dispensing device having at least one passage to direct one or more articles from said magazine passages and from said housing with each step of its rotational movement, means normally biasing said dispenser device to an interengaged relation with means at one end of said housing to the side of said magazine which is remote from said chamber area, said biasing means being arranged to accommodate an axial displacement of said dispensing device to permit a step by step rotational movement thereof as and to the extent required.

9. A dispenser as in claim 8 wherein said chamber area is formed in part by means defining one end of said article directing means the body of which includes a plurality of through passages leading from said chamber area to said magazine the chambers of which are adapted to align with the passages in said article directing means in the inoperative condition of said dispensing device, and said dispensing device has at least one aperture forming said one passage therein which moves to align with and pass one of said magazine chambers during each step of movement of said dispensing device.

* * * * *

UNITED STATES PATENT AND TRADEMARK OFFICE

CERTIFICATE OF CORRECTION

PATENT NO. : 4,150,766

DATED : April 24, 1979

INVENTOR(S) : Thomas H. Westendorf and Robert H. Knorr

It is certified that error appears in the above-identified patent and that said Letters Patent are hereby corrected as shown below:

Col. 4, line 60, "above the drum 26" is deleted.

Col. 12, line 63 (Claim 8, line 1), "table" is corrected to read -- tablet --.

Signed and Sealed this

*Twenty-first* Day of *August 1979*

[SEAL]

*Attest:*

*Attesting Officer*

LUTRELLE F. PARKER

*Acting Commissioner of Patents and Trademarks*